US005933920A

United States Patent [19]

Winn

[11] Patent Number: 5,933,920

[45] Date of Patent: Aug. 10, 1999

[54] HIGH SLIPPAGE FEEDER FOR A COTTON GIN

[76] Inventor: William E. Winn, P.O. Box 702, Levelland, Tex. 79336

[21] Appl. No.: 09/057,580

[22] Filed: Apr. 9, 1998

Related U.S. Application Data

[60] Provisional application No. 60/041,852, Apr. 9, 1997.

[51] Int. Cl.[6] ..... D01B 1/04; B65G 53/08

[52] U.S. Cl. ..... 19/48 R; 19/39; 19/40; 19/41; 19/64.5; 19/205; 406/65

[58] Field of Search ..... 19/39, 40, 41, 19/48 R, 64.5, 205; 406/65, 67, 144

[56] References Cited

U.S. PATENT DOCUMENTS

| | | | |
|---|---|---|---|
| 555,789 | 3/1896 | Munger | 19/39 |
| 2,418,694 | 4/1947 | Brooks | 19/39 |
| 2,948,022 | 8/1960 | Day | 19/205 |
| 4,031,593 | 6/1977 | Vandergriff | 19/27 |
| 4,143,470 | 3/1979 | Vandergriff | 34/10 |
| 4,470,172 | 9/1984 | Leifeld | 19/64.5 |
| 5,040,270 | 8/1991 | Mackey . | |
| 5,392,495 | 2/1995 | Horn | 19/55 R |
| 5,533,276 | 7/1996 | Vandergriff | 34/583 |

OTHER PUBLICATIONS

G. Mangialardi, Jr., "Lint Cleaning", Cotton Ginners Handbook, U.S. Department of Agriculture, Agriculture Handbook No. 503, Jul. 1977, pp. 35–43.

W.E. Garner and R.V. Baker, "Cleaning and Extracting", Cotton Ginners Handbook, U.S. Department of Agriculture, Agriculture Handbook No. 503, Jul. 1977, pp. 18–29.

"Development of the Cotton Gin," from the Cotton Ginners Handbook, U.S. Department of Agriculture, Dec. 1994, pp. 1–6, Editors W.S. Anthony and W.D. Mayfield.

W.D. Mayfield, R.V. Baker, S.E. Hughs, and W.S. Anthony, "Introduction to a Cotton Gin", U.S. Department of Agriculture, National Cotton Ginners Association, pp. 3–11.

*Primary Examiner*—John J. Calvert
*Assistant Examiner*—Gary L. Welch
*Attorney, Agent, or Firm*—Finnegan, Henderson, Farabow, Garrett & Dunner, L.L.P.

[57] ABSTRACT

A high slippage feeder for conveying seed cotton from a rotary vacuum of a cotton gin includes a cylinder rotating about an axis with a plurality of pins radially extending from the cylinder and a casing enclosing the cylinder and the pins. The casing has a first inlet for receiving the seed cotton from the rotary vacuum, a second inlet for receiving an air stream, and an outlet for providing an exit for the air stream and the seed cotton. A portion of the casing is curved to conform to an outer circumference defined by the rotation of the pins, and a portion of the second inlet is inwardly deflected to focus the direction of the air stream. The casing, as shaped, maximizes the operational efficiency of the high slippage feeder and not only improves the conveyance of cotton but also ensures that a majority of the cotton conveyed through the high slippage feeder will be partially dried.

11 Claims, 2 Drawing Sheets

HIGH SLIPPAGE FEEDER FOR A COTTON GIN

This application claims benefit of Provisional Application Ser. No. 60/041,852 filed Apr. 9, 1997.

BACKGROUND OF THE INVENTION

1. Field of the Invention

The present invention concerns an aspect of the design and operation of cotton gins. More specifically, the present invention is directed toward an improvement in the design of high slippage feeders for cotton gins.

2. Description of the Prior Art

Since the cotton gin was first developed by Eli Whitney more than a century ago, the basic task of separating seeds, plant material and other small objects from fibers of the cotton has evolved considerably. Primarily in response to increasing consumer demand for cotton that is substantially free of such trash, numerous devices have been added to the cotton gin to improve the cleanliness of the cotton produced. One such improvement is the hot shelf tower dryer, which is a direct application to the ginning process of the principle that drier cotton is easier to clean than wetter cotton. Other improvements, such as cleaners and extractors, also have been developed to improve the overall efficacy of the ginning process. Typically cleaners remove fine trash, leaves, and dirt, from the cotton while extractors remove burs and sticks.

Once cleaned by some or all of these ancillary machines or equipment, the cotton must be transported to other sections of the cotton gin. Typically, the cotton is conveyed by a rotary vacuum connected to a high slippage feeder. A high slippage feeder may be used in any location where cotton is to be conveyed from one part of the cotton gin to another and is not limited just to the location between the cleaners, extractors, hot shelf tower dryer and gin.

U.S. Pat. No. 5,392,495, the disclosure of which is incorporated herein by reference, describes a high slippage feeder connected to a rotary vacuum for conveying cleaned seed cotton. Conventionally, the cleaned seed cotton exits the cleaning or extracting machinery through a rotary vacuum connected to a high slippage feeder, as illustrated in FIG. 1. The seed cotton simply drops from rotary vacuum 50 into high slippage feeder 52 for conveyance through the remainder of the cotton gin. Because the conventional high slippage feeder conveys cotton using a simplistic design, it does not operate at maximum efficiency or efficacy.

This deficiency has created a specific need for an improvement in high slippage feeders. As set forth in greater detail below, the present invention addresses this need.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a high slippage feeder for conveying seed cotton from a rotary vacuum of a cotton gin. The high slippage feeder of the present invention includes a casing enclosing a cylinder with a plurality of pins extending radially from the cylinder. The casing has a first inlet for receiving the seed cotton from the rotary vacuum, a second inlet for receiving an air stream, and an outlet for providing an exit for the air stream and the seed cotton. To enhance the direction of the air stream, a portion of the second inlet is inwardly deflected at a predetermined angle.

In another aspect, the high slippage feeder comprises a casing enclosing a cylinder with a plurality of pins radially extending from the cylinder. The cylinder rotates about an axis, where the rotation of the pins, which extend from the cylinder, defines an outer circumference. The casing presents a first inlet for receiving the seed cotton from the rotary vacuum, a second inlet for receiving an air stream, and an outlet for providing an exit for the air stream and the seed cotton. A portion of the casing is curved to conform to the outer circumference defined by the rotation of the pins.

In yet another aspect, a portion of the second inlet is inwardly deflected at a predetermined angle to enhance the direction of the air stream and a portion of the casing curves to conform to the outer circumference defined by the rotation of the pins.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate preferred embodiments of the invention and, together with the description, serve to explain the principles of the invention. In the drawings.

DESCRIPTION OF THE PREFERRED EMBODIMENT(S)

Reference will now be made in detail to the present preferred embodiment of the invention, an example of which is illustrated in the accompanying drawings. Wherever possible, the same reference numbers will be used throughout the drawings to refer to the same or like parts.

In accordance with the invention, there is provided a high slippage feeder for conveying seed cotton from a rotary vacuum of a cotton gin. In order to improve the cotton ginning process, the present invention includes a high slippage feeder that maximizes operational efficiency and efficacy. The high slippage feeder includes a cylinder rotating about an axis with a plurality of pins extending from the cylinder. A casing encloses the cylinder and the pins. The casing presents a first inlet for receiving the seed cotton from the rotary vacuum, a second inlet for receiving an air stream, and an outlet for providing an exit for the air stream and the seed cotton. A portion of the structure of the casing is curved to conform to an outer circumference defined by the rotation of the pins. Finally, a portion of the second inlet is inwardly deflected to direct the air stream toward the pins.

Figure 1:
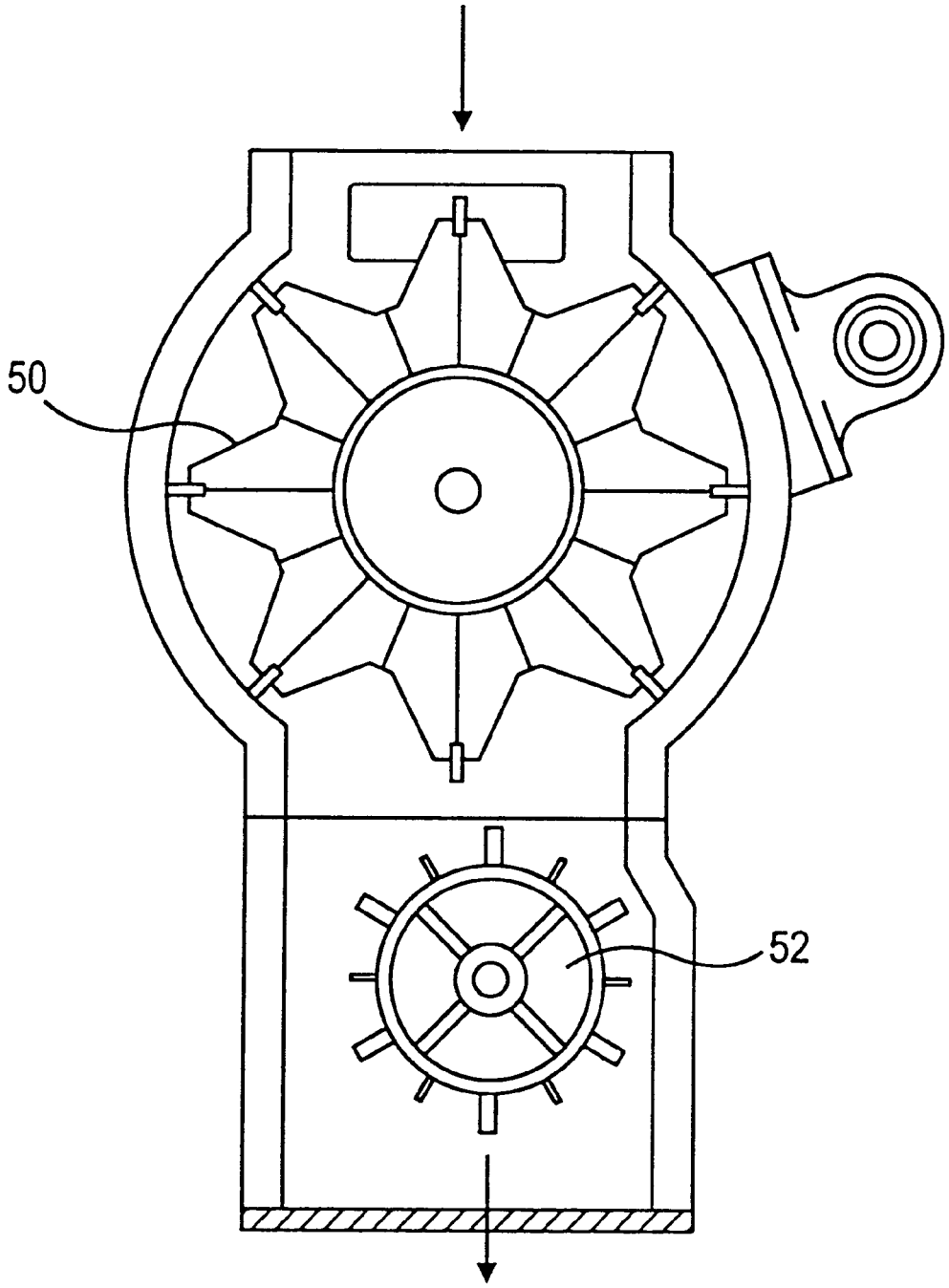
FIG. 1 PRIOR ART
FIG. 1 is a side view illustration of a conventional high slippage feeder connected to a rotary vacuum.
Figure 2:
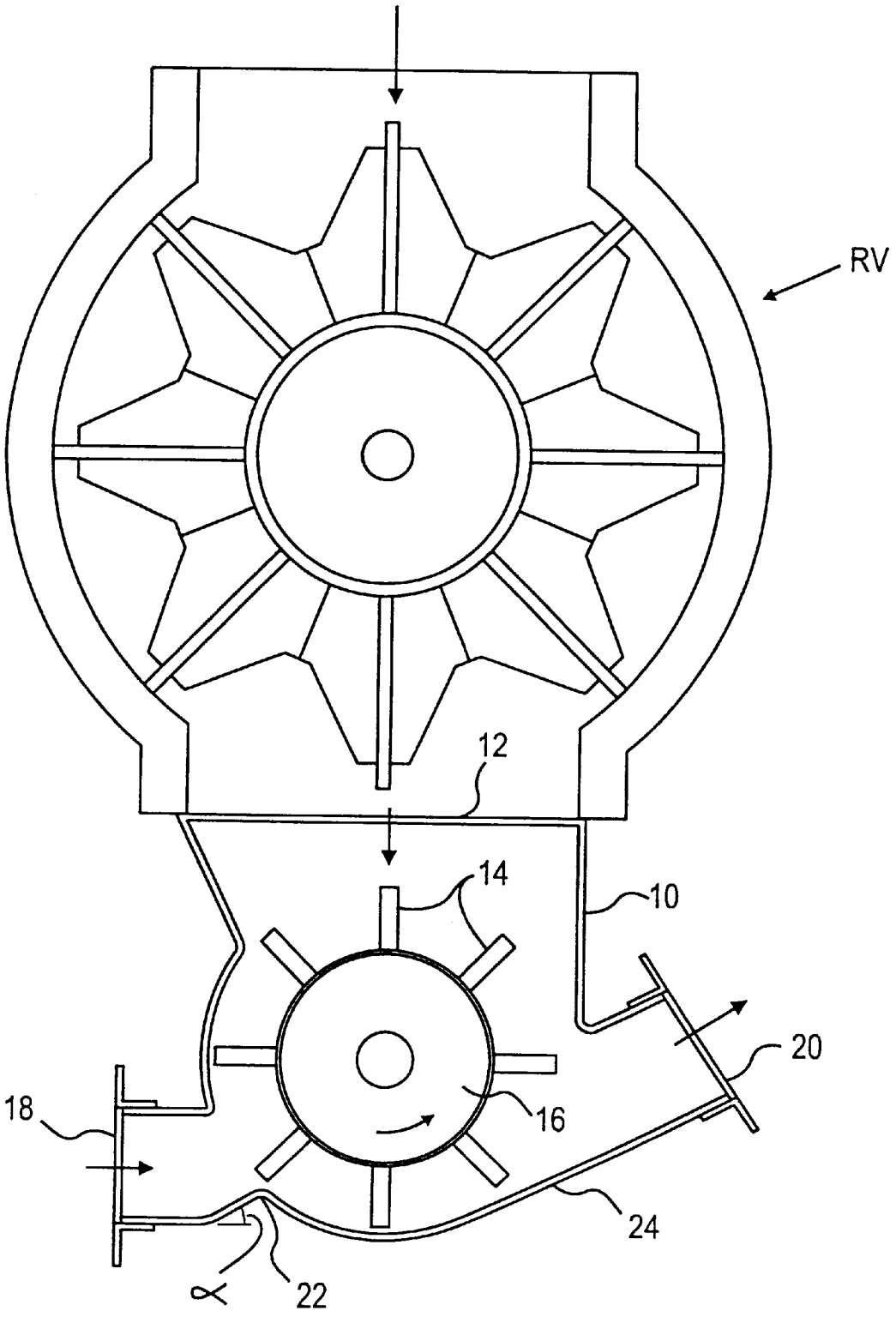
FIG. 2 is a side view illustration of the high slippage feeder of the present invention connected to a rotary vacuum.

A preferred embodiment of high slippage feeder 10 of the present invention is depicted in FIG. 2. As illustrated, high slippage feeder 10 draws cotton fibers from rotary vacuum RV through first inlet 12 onto pins 14 disposed on cylinder 16. Cylinder 16 and, consequently, pins 14 rotate in a counterclockwise direction (as indicated in FIG. 2) at a speed of about 1,200 feet per minute. Pins 14 engage the cotton fibers and carry the fibers into the hot air stream, which enters feeder 10 through second inlet 18 at a velocity of about 4,000 feet per minute. The cotton is drawn through the feeder until it is discharged through outlet 20.

Feeder 10 incorporates a deflector 22 in casing 24 to direct the hot air stream as it enters feeder 10 through second inlet 18. Without deflector 22, the hot air would travel in an essentially circumferential direction with respect to cylinder 16. The shape of deflector 22 alters the path of the hot air so that it is directed radially with respect to cylinder 16 as it enters feeder 10. So directed, the hot air tends to push the cotton fibers against pins 14. To emphasize the force of the hot air on the cotton so that it more effectively pushes the cotton onto pins 14, deflector 22 is angled, at angle $\alpha$, preferably about 45° to the horizontal, as shown in FIG. 2. The hot air pushes and holds the cotton fibers against pins 14 as it washes over the fibers at more than 3 times the velocity of pins 14. Moreover, as it passes over the fibers, the hot air partially dries the cotton.

Casing 24 is shaped to maximize the operational efficiency of feeder 10. As shown in FIG. 2, casing 24 is shaped so that its interior surface wraps around a portion of the cross-sectional periphery of cylinder 16 (with projecting pins 14). Additionally, the interior surface of casing 24 is disposed very near to the tips of pins 14. As a result, there is a very close engineering tolerance between the tips of pins 14 and the interior surface of feeder 10. Since pins 14 rotate close to the interior surface of casing 24, there is very little leakage of hot air or cotton fibers around the tips of pins 14. The design of casing 24, therefore, ensures that most of the cotton entering through first inlet 12 will be partially dried because it must be drawn by pins 14 around the circumference of cylinder 16 past second inlet 18. Casing 24, therefore, significantly enhances the operational efficiency of feeder 10 over high slippage feeders known in the art that do not incorporate the housing design of the present invention.

It will be apparent to those skilled in the art that various modifications and variations can be made in the high slippage feeder of the present invention and in construction of this high slippage feeder without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A high slippage feeder for conveying seed cotton from a rotary vacuum of a cotton gin comprising:

a cylinder rotatable about an axis;

a plurality of pins extending radially from the cylinder for engaging the seed cotton as the seed cotton is directed passed the cylinder; and a casing enclosing the cylinder and the plurality of pins, the casing having a first inlet for receiving the seed cotton from the rotary vacuum, a second inlet for receiving an air stream, wherein a portion of the second inlet is deflected at a predetermined angle to direct the air stream toward the plurality of pins to emphasize the force of the air stream on the seed cotton, thereby pushing the seed cotton onto the plurality of pins, and an outlet for providing an exit for the air stream and the seed cotton.

2. The high slippage feeder as recited in claim 1, wherein a portion of the casing curves to conform to an outer circumference defined by the rotation of the plurality of pins.

3. The high slippage feeder as recited in claim 2, wherein:

a first portion of the casing between the first inlet and the second inlet and a second portion of the casing between the second inlet and outlet curve to conform to the outer circumference defined by the rotation of the plurality of pins.

4. The high slippage feeder as recited in claim 3, wherein:

the plurality of pins extend radially from the cylinder proximate to an interior surface of the first portion of the casing and the second portion of the casing.

5. The high slippage feeder as recited in claim 2, wherein:

the cylinder rotates about the axis in a direction from the first inlet to the second inlet.

6. The high slippage feeder as recited in claim 5, wherein:

the cylinder rotates at approximately 1,200 feet per minute.

7. The high slippage feeder as recited in claim 6, wherein:

the air stream enters the second inlet at approximately 4,000 feet per minute.

8. The high slippage feeder as recited in claim 2, wherein:

the plurality of pins are spaced substantially equidistantly around the cylinder.

9. The high slippage feeder as recited in claim 1, wherein:

the portion of the second inlet is deflected at an angle of about 45°.

10. The high slippage feeder as recited in claim 1, wherein:

the air stream received by the second inlet is heated.

11. A high slippage feeder for conveying seed cotton from a rotary vacuum of a cotton gin comprising:

a cylinder rotatable about an axis;

a plurality of pins extending from the cylinder for engaging the seed cotton; and a casing enclosing the cylinder and the plurality of pins and having a first inlet for receiving the seed cotton from the rotary vacuum, a second inlet for receiving an air stream and an outlet for providing an exit for the seed cotton and the air stream, wherein a portion of the second inlet is deflected at a predetermined angle to radially direct the air stream with respect to the cylinder to emphasize the force of the air stream on the seed cotton, thereby pushing the seed cotton toward the plurality of pins, and wherein the casing curves to conform to an outer circumference defined by the rotation of the plurality of pins.

* * * * *